US006112654A

United States Patent [19]

Jaffa

[11] Patent Number: 6,112,654

[45] Date of Patent: Sep. 5, 2000

[54] POLYGONAL PRINTING APPARATUS

[75] Inventor: David Jaffa, Franklin Lakes, N.J.

[73] Assignee: Hix Corporation, Pittsburg, Kans.

[21] Appl. No.: 08/951,969

[22] Filed: Oct. 16, 1997

[51] Int. Cl.[7] ..... B41F 15/00

[52] U.S. Cl. ..... 101/114; 101/126

[58] Field of Search ..... 101/114, 126, 101/115, 116, 117, 118, 54

[56] References Cited

U.S. PATENT DOCUMENTS

| | | | |
|---|---|---|---|
| Re. 29,160 | 3/1977 | Jaffa . | |
| Re. 29,206 | 5/1977 | Jaffa . | |
| 1,125,180 | 1/1915 | Rugers | 101/54 |
| 3,990,364 | 11/1976 | Paans | 101/126 |
| 4,031,825 | 6/1977 | Jaffa . | |
| 4,091,726 | 5/1978 | Walker | 101/126 |
| 4,407,195 | 10/1983 | Jaffa . | |
| 4,478,142 | 10/1984 | Santorineos | 101/126 |
| 4,606,268 | 8/1986 | Jaffa . | |
| 4,735,139 | 4/1988 | Szarka . | |
| 4,846,058 | 7/1989 | Farris . | |
| 4,909,146 | 3/1990 | Szarka . | |
| 4,938,130 | 7/1990 | Thorpe . | |
| 5,127,321 | 7/1992 | Proffer . | |
| 5,438,922 | 8/1995 | Bubley et al. . | |
| 5,456,172 | 10/1995 | Herrmann . | |
| 5,483,882 | 1/1996 | Jaffa . | |
| 5,607,243 | 3/1997 | Szarka . | |
| 5,711,216 | 1/1998 | Tiemann et al. | 101/118 |

*Primary Examiner*—Eugene Eickholt
*Attorney, Agent, or Firm*—Shook Hardy & Bacon LLP

[57] ABSTRACT

In one embodiment, a printing apparatus which includes a polygonal support frame, a plurality of spaced apart pallets movably mounted on the support frame, and a pallet drive assembly mounted to the support frame and connected to the pallets for indexing the pallets around the support frame to desired printing locations.

14 Claims, 10 Drawing Sheets

POLYGONAL PRINTING APPARATUS

FIELD OF THE INVENTION

The present invention relates to printing apparatuses generally and, more particularly, but not by way of limitation, to a novel polygonal printing apparatus.

BACKGROUND OF THE INVENTION

The present invention concerns printing apparatuses in general, for example, screen printing or graphic arts apparatuses, which typically include printing apparatuses of the endless drive path varieties.

Heretofore, various types of printing devices have been used. In general, several ways of conveying a substrate to a singular printing position, or multiple positions, have been employed, including: an endless printing blanket traveling horizontally with an upper print surface and a lower return flight; an endless chain having pallets attached which travel along a circular path with upper and lower return levels; an endless chain with pallets attachments traveling in an oval configuration on a single horizontal plane; and a series of platens attached to a central rotatable hub from which pallets and screens extend outward to a circular circumference, wherein the screens and pallets travel on a horizontal plane following the pathway determined by the circumference of the circle.

Thus, one example of a known screen printing device drives a plurality of supported pallets around an endless path, wherein the pallets are indexed to desired printing stations, for example where a printing head may be located, so as to impart a screened pattern of ink from the printing head onto a substrate, such as an article of clothing. Various patterns or colors may be disposed onto the clothing during its journey through the endless path. Such known devices are described in the following patents, all of which are incorporated herein as if fully set out in their entirety: U.S. Pat. No. Re. 29,160 issued to Jaffa; U.S. Pat. No. 4,407,195 issued to Jaffa; and U.S. Pat. No. 5,456,172 issued to Herrmann. The path of the pallets on these oval track machines thus comprises two parallel straight sections and two arcuate end sections. In order to provide an increased number of printing stations, the length of the parallel straight sections must be increased. Consequently, sufficient factory floor space must be provided which can accommodate the boundaries of such a machine. That is, a substantially elongated rectangular block of floor space must be available in order to increase the printing capacity provided by such machines. Furthermore, the arcuate end sections of the path are typically not utilized for printing, as the pallets experience considerable centrifugal acceleration as they are whipped around these sections as necessitated by a desired production speed of the pallets which generates an acceptable number of printed material at an acceptable rate. Consequently, the connections between the pallets and the means for driving the pallets around the endless path suffer various stresses, leading to increased maintenance costs. One approach to the problem of high stresses on these connections provided resilient mounts for absorbing some of the undesirable forces.

Another type of known printing device is the round or rotary screen printing device. For example, a plurality of screens may be mounted coaxially with a plurality of workpiece supporting pallets such that the transfer of ink through the screens to the workpieces is achieved by rotation about a single upright axis. Such known devices are described in the following patents, all of which are incorporated herein as if fully set out in their entirety: U.S. Pat. No. 4,606,268 issued to Jaffa; and U.S. Pat. No. 5,438,922 issued to Bubley et al. Such devices require rotation of a large assembly about a single axis, requiring large torques, and resulting in high drive requirements and high maintenance costs due to wear. Furthermore, these devices require a considerable block of floor space. For example, a certain minimum size rotary machine is required to accommodate a minimum number of pallets, since the pallets, or the desired printing surfaces, typically require a minimum printing area width. When the inner ends of a plurality of typical rectangular shaped pallets are spaced around a circle, a minimum diameter circle is defined for a given number of pallets. In other words, the rear ends of the pallets converge. If it is desired to increase the number of pallets, the circle must be widened. Thus, the overall size and diameter of such machines increases rapidly as the number of pallets which the device can accommodate is increased, thereby increasing loads and stresses on the machine, and thereby increasing the demand for a large block of factory space. Furthermore, registration becomes more difficult as the circumference becomes larger.

Various other known screen printing apparatuses and subsystems therefor already exist. For example, the following patents, all of which are incorporated as if fully set out herein, describe various screen printing devices: U.S. Pat. Nos. 4,031,825; 4,735,139; 4,846,058; 4,909,146; 4,938,130; 5,483,882; and 5,607,243.

Thus, known devices are limited in flexibility to efficiently and effectively accommodate various numbers of pallets or printing stations, and further do not provide flexibility with respect to factory floor plan constraints.

As used herein, "pallet" generally refers to a workpiece support which is driven along a path so as to place a workpiece into a desired printing location with respect to a printing head. Thus, a pallet may refer to a member which is attached to a pallet drive means and which may be elsewhere be variously referred to as a "pallet support" or the like. Additionally, as used herein, the term "pallet" may also comprise another member which is attached to such a support or base support, wherein such other member may be adapted to further hold the workpiece in a desired manner, and which may be referred to by a skilled artisan as a pallet. Thus, as used herein, the term "pallet" is intended to broadly encompass a pallet means, or a pallet assembly, which may include a pallet support and an additional member which further supports the workpiece disposed thereon.

As used herein, "polygonal" generally refers to the configuration or shape derived from a polygon, i.e. a closed plane figure bounded by three or more line segments The term "polygonal" is intended to broadly encompass a wide variety of shapes, including regular and irregular formations.

OBJECTS OF THE INVENTION

A primary object of the present invention is to provide a printing apparatus offers flexibility and adaptability in its overall configuration.

Another object of the present invention is to provide a printing apparatus which maximizes the number of useable printing stations for a given footprint.

Still another object of the present invention is to provide a printing apparatus which minimizes undesirable loads and stresses induced during movement of the pallets around an endless loop.

It is yet another object of the present invention to provide a printing apparatus which can be expanded in any direction atop a generally horizontal floor surface.

Other objects of the present invention, as well as particular features, elements, and advantages thereof, will be elucidated in, or be apparent from, the following description and the accompanying drawing figures.

SUMMARY OF THE INVENTION

The present invention achieves the above objects among others, by providing a novel printing apparatus.

In one aspect, the present invention comprises a printing apparatus comprising means for driving a plurality of workpiece supports around an endless path having at least three vertices.

In another aspect, the present invention comprises a printing apparatus comprising a polygonal support frame, a plurality of spaced apart pallets movably mounted on the support frame, and pallet drive means mounted to the support frame and connected to the pallets for indexing the pallets around the support frame to desired printing locations. The path of the pallets comprises at least one straight line of travel, and all of the pallets which are disposed on each straight line of travel are preferably substantially perpendicular to the straight line of travel and are substantially parallel to each other.

The printing apparatus may be configured into an irregular polygonal shape or a regular polygonal shape. The support frame may generally describe a regular or an irregular polygonal shape.

Preferably, the printing apparatus, or the support frame, comprises an inner periphery which surrounds an open central space.

In a preferred embodiment, the pallet drive means comprises an endless drive means for driving the pallets around an endless path, the endless drive means including a plurality of pivot means disposed at respective vertices of the support frame for providing vertices for the endless path, wherein a respective pivot means is disposed at at least three different pivot points. The pivot means may include at least one upright shaft, wherein each shaft is disposed at a respective vertex of the support frame.

The pivot means may include at least one wheeled member, wherein at least one wheeled member is disposed at a respective vertex of the support frame. At least one of the wheeled members may be driven.

In one preferred embodiment, the plurality of pivot means comprises at least three wheel members. The endless drive means may include an endless chain, and the pivot means may include at least one sprocket for engaging the endless chain.

The pallets may be resiliently mounted to the pallet drive means.

The present invention preferably includes a novel means for attaching each pallet to the endless chain.

The pallet is optionally resiliently mounted to the pallet drive means.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
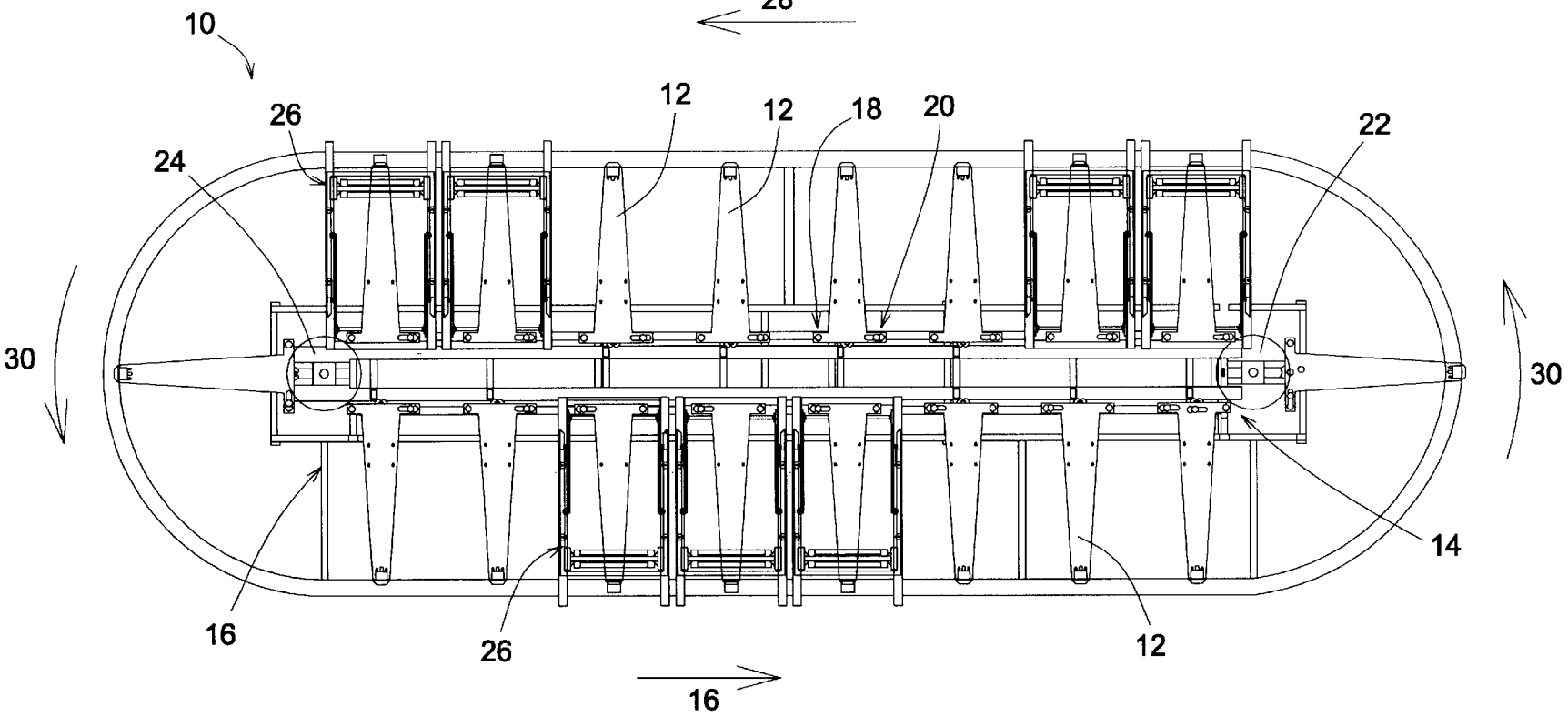
Fig. 1. (Prior Art)
FIG. 1 is a top plan view of a representative known oval screen printing apparatus.

In one aspect, the present invention comprises a printing apparatus comprising means for driving a plurality of workpiece supports around an endless path having at least three vertices.

In another aspect, the present invention comprises a printing apparatus comprising a polygonal support frame, a plurality of spaced apart pallets movably mounted on the support frame, and pallet drive means mounted to the support frame and connected to the pallets for indexing the pallets around the support frame to desired printing locations. The path of the pallets comprises at least one straight line of travel, and all of the pallets which are disposed on each straight line of travel are preferably substantially perpendicular to the straight line of travel and are substantially parallel to each other.

The printing apparatus may be configured into an irregular polygonal shape or a regular polygonal shape. The support frame may generally describe a regular or an irregular polygonal shape.

The printing apparatus may also comprise a plurality of printing heads mounted on the support frame, the printing heads substantially defining a respective plurality of printing stations, wherein the pallet drive means indexes the pallets to respective desired printing stations.

Preferably, the printing apparatus, or the support frame, comprises an inner periphery which surrounds an open central space.

The support frame may comprise at least one generally polygonal rail. In one preferred embodiment, the support frame includes a chain guide.

In a preferred embodiment, the pallet drive means comprises an endless drive means for driving the pallets around an endless path, the endless drive means including a plurality of pivot means disposed at respective vertices of the support frame for providing vertices for the endless path, wherein a respective pivot means is disposed at at least three different pivot points. The pivot means may include at least one upright shaft, wherein each shaft is disposed at a respective vertex of the support frame.

The pivot means may include at least one wheeled member, wherein at least one wheeled member is disposed at a respective vertex of the support frame. At least one of the wheeled members may be driven. In another embodiment, at least two of the wheeled members are substantially simultaneously driven.

In one preferred embodiment, the plurality of pivot means comprises at least three wheel members. At least one of the wheeled members may be a drive sprocket and at least one other wheeled member may be a tensioning sprocket. The printing apparatus may include means for driving at least one of the wheeled members.

In one preferred embodiment, the endless drive means further comprises an endless chain. The pivot means may include at least one sprocket for engaging the endless chain.

The pallets may be resiliently mounted to the pallet drive means.

Thus, the pallet drive means may include an endless drive means including a movable endless chain.

The printing apparatus preferably includes means for pivotally attaching the midpoint of the rear end of each pallet to the endless chain.

The path of the endless chain includes a tangential approach portion, a traverse portion, and a tangential departing portion associated with each pivot point, for example, with each wheeled member, wherein the endless chain contacts the associated wheeled member in the traverse portion, and wherein a line passing through the tangential approach portion and a line passing through the tangential departing portion intersect one another.

Preferably, the pallet is essentially normal to the endless chain when disposed at the juncture between the traverse portion and the tangential departing portion.

The printing apparatus further preferably comprises means for pivotally and slidingly attaching the leading end of each pallet to the endless chain. In a preferred embodiment, the leading end of the pallet slides with respect to the endless chain, and the midpoint of the pallet pivots about an upright axis with respect to the endless chain, as the pallet passes around the traverse portion.

In a preferred embodiment, the printing apparatus includes means for allowing the rear portion of the pallet to pivot with respect to the endless chain about an upright axis passing through the longitudinal centerline of the pallet while allowing the leading edge of the rear portion to slide with respect to the endless chain, whereby the pallet is able to follow the curvilinear portion of the endless path around a respective wheeled member. The longitudinal axis of the pallet is thus essentially perpendicular to the endless chain at the point where the endless chain departs the respective wheeled member.

The present invention further contemplates a pallet which includes an elongated body generally disposed about a longitudinal centerline which extends from a front end to a rear end, wherein the body is advanced around the support frame while being maintained in a generally horizontal orientation with the front end being directed outwardly, the elongated body having a rear portion for attachment with the pallet drive means, the rear portion including leading and trailing sides oppositely disposed about the longitudinal centerline, wherein the rear portion is provided with a substantially circular opening substantially at its midpoint and with a slotted opening proximate its leading side. The pallet is optionally resiliently mounted to the pallet drive means.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

FIG. 1 is a top plan view of a representative known oval screen printing apparatus 10. A plurality of pallets or pallet assemblies 12 are coupled to an endless chain 14 in order to be driven thereby along an oval path atop a support frame 16. The pallet assemblies 12 may be secured to the endless chain 14 by means of chain link pins. One of the pins is engaged with a closely fitting hole in the leading side 18 of each pallet assembly 12 while the other pin is engaged within an elongated slot disposed at the trailing end 20. The endless chain 14 is trained about first and second sprockets 22, 24. A motor is used to drive the first sprocket 22 through an indexing means which moves the endless chain 14 in a given direction and stops the chain after the chain has traveled by a predetermined amount, i.e. with a given repeat. Thus, a pallet 12 bearing a workpiece may be brought to a printing station into the proximity of a printing head 26 (or to a workpiece loading or unloading station, or to a flash or drying station). The pallet 12 is typically further positioned or located into a desired orientation with respect to the printing screen in the printing head 26. The workpiece and screen are typically brought into further proximity and a dose of ink or the like is imparted to the workpiece through the screen thereby imprinting the workpiece with a given pattern and/or color.

Still referring to FIG. 1, the oval path of the pallets 12 comprises two parallel straight sections 28 and two arcuate end sections 30. Typically, the arcuate end sections 30 of the path are not utilized for printing, as the pallets experience considerable centrifugal acceleration as they are whipped around these sections at desired production speeds.

One example of such an oval screen printing apparatus is described in columns 4–11 of U.S. Pat. No. 4,407,195.

Resilient mounts may be provided at the connection between the endless chain 14 and the pallets 12 so as to allow the pallet some movement relative to the pins and/or the chain when an external force is exerted upon the edges of the pallet, whether due to a locator means or to centrifugal forces. One example of resilient mounting is described in column 3 of U.S. Pat. No. 4,735,139.

Figure 2:
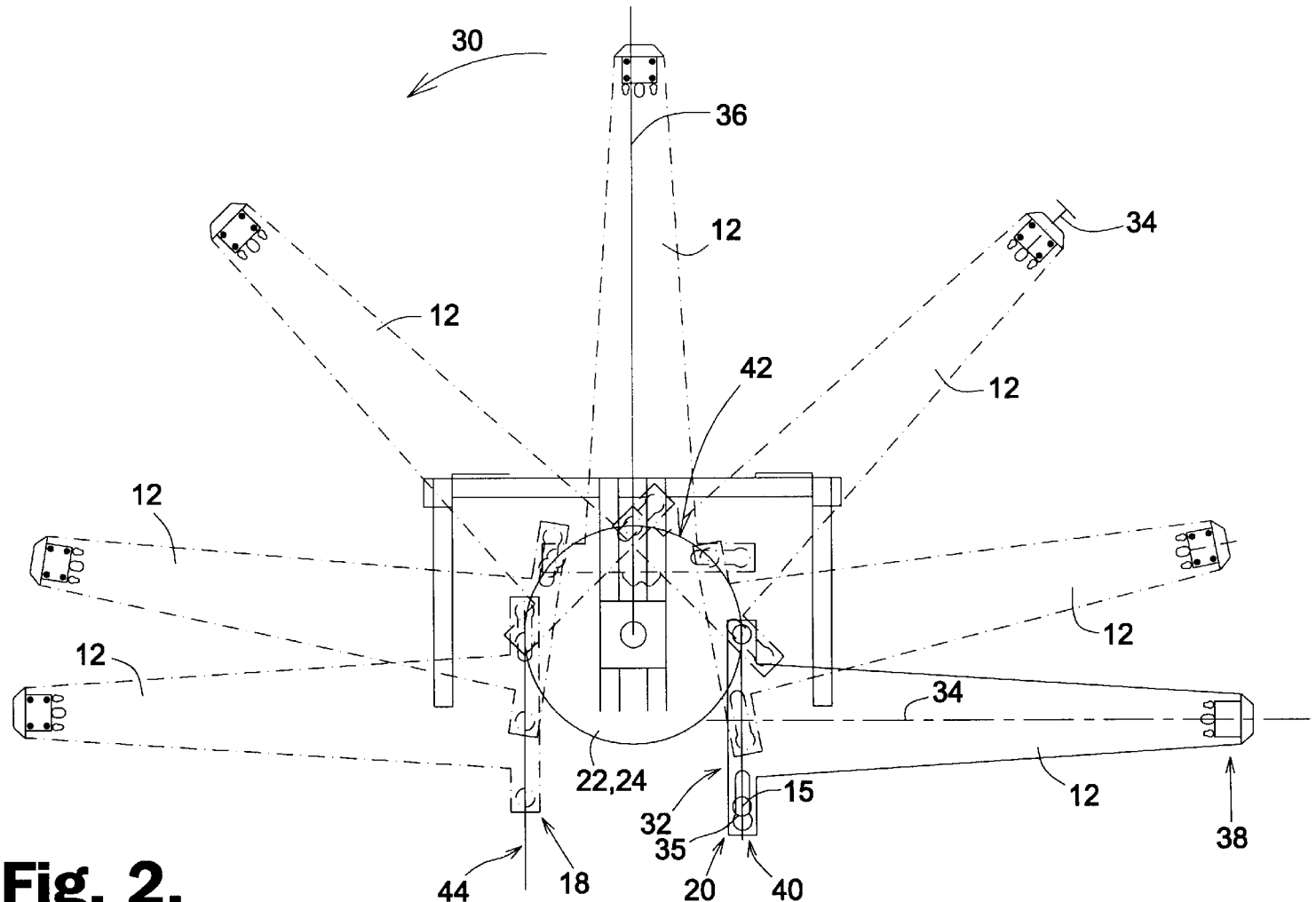
Fig. 2. (Prior Art)
FIG. 2 illustrates the sequence of pallet positions experienced by a given pallet during its travel around the arcuate portion of the endless oval path according to known oval printing devices.

FIG. 2 illustrates the sequence of pallet positions experienced by a given pallet during its travel around the arcuate portion 30 of the endless oval path according to known oval printing devices. The rear end 32 of the pallets are provided with leading and trailing sides 18, 20 oppositely disposed about the longitudinal centerline 34, wherein the rear portion 32 is provided with a substantially circular opening proximate its leading side 18 and with a slotted opening proximate its trailing side 20. Resilient mounts 35, which are attached to the pins 15 or endless chain 14, may be disposed in the openings. Thus, lateral movement within the slotted opening compensates for changes in distance between the two supporting pins when the chain 14 travels around the curved sections 30 of the oval drive chain path, thus preventing binding at those sections. It should be noted that the rear end 32 of the pallet 12 is typically recessed, i.e. the pallet overlaps part of the sprocket 22 or 24, as the pallet traverses the endmost section of the oval. It should also be noted that the pallet 12 is not essentially normal (perpendicular) to the line 36 intersecting the centers of the two sprockets 22,24; rather, the tip or front 38 of the pallet 12 typically "lags" the traversing movement of its pivoting (but otherwise fixed) leading pivot end 18. For example, when the midpoint of the rear portion 32 of the pallet 12 advances to the juncture between the tangential approach portion 40 of the endless path and the traverse portion 42 of the endless path, the pallet 12 is not essentially normal or perpendicular to the tangential approach portion 40 of the chain 14. Furthermore, when the midpoint of the rear portion 32 of the pallet 12 advances to the juncture between the traverse portion 42 of the endless path and the tangential departing portion 44 of the endless path, the pallet 12 is not essentially normal or perpendicular to the tangential departing portion 44 of the chain 14. Thus, the end portion of the endless path, which corresponds to the point where the leading pivot point of the rear portion 32 of the pallet 12 starts to follow an arcuate path until the point where the trailing sliding and pivoting point of the rear portion of the pallet starts to follow a straight path, is not utilized for printing as a printing head would not be located at a spot where the pallet is not substantially perpendicular to the chain, nor is it desirable to position a printing head where the pallet is recessed.

Figure 3:
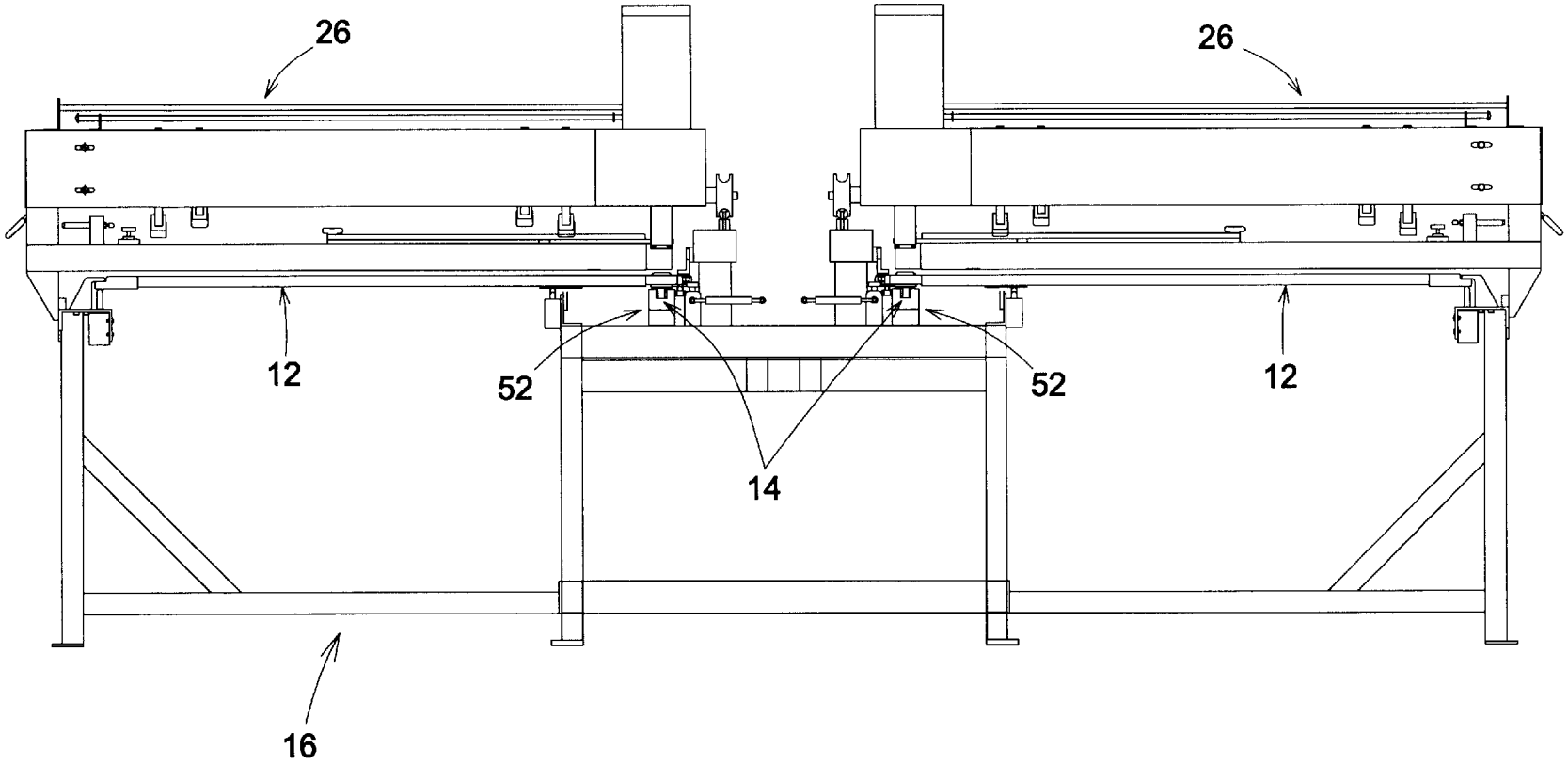
Fig. 3. (Prior Art)
FIG. 3 shows a cutaway end elevational view of the middle portion of the known device of FIG. 1 which reveals an end view of the straight path.

FIG. 3 shows a cutaway end elevational view of the middle portion of the known device of FIG. 1 which reveals an end view of the straight path. The support frame 16 comprises a chain guide 52 which contains an endless chain which drives the pallets 12 around an endless path. Printing heads 26 are disposed on the support frame 16.

The present invention relates to a printing device which may be configured in a variety of geometric patterns by providing a polygonal pallet drive path having at least three pivot points.

Figure 4:
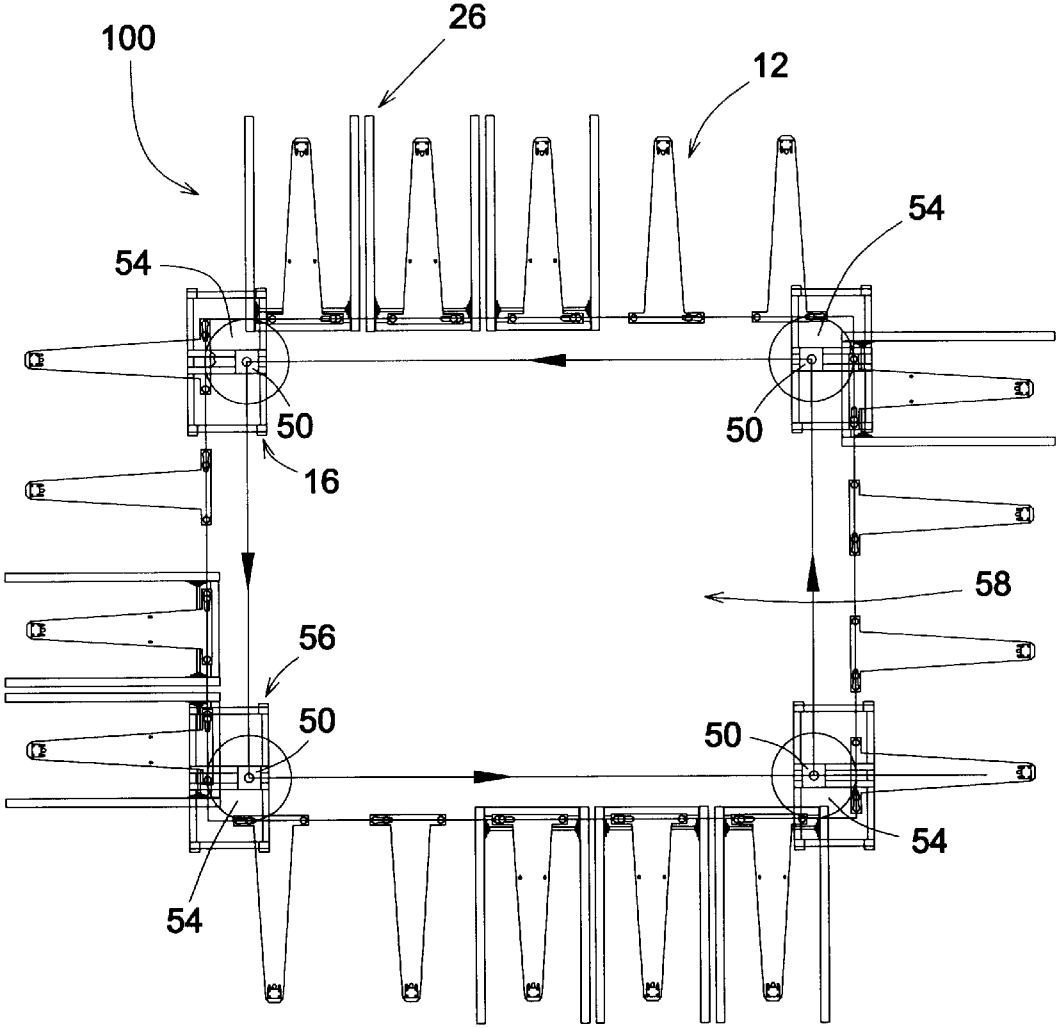
FIG. 4 illustrates a top plan view of one embodiment of the present invention.

FIG. 4 illustrates a top plan view of one embodiment 100 of the present invention. A plurality of pallets or pallet assemblies 12 are coupled to an endless chain 14 in order to be driven thereby along an endless path atop a support frame 16. Only several portions of the support frame 16 are shown for illustration purposes. The outlines of nine printing head assemblies 26 are shown for the sake of clarity of the illustration. The printing apparatus has four corners or vertices 50. Four wheeled members 54 are supported at the vertices 50 of the endless path, wherein the path of each pallet 12 turns or changes its direction upon encountering a wheeled member 54. The device 100 shown has an inner periphery 56 which surrounds an open space 58.

The open space 58 may be advantageously utilized, for example, to store goods, screens, and/or printing materials, to provide office space or a control center space, or whatever use the user may desire. For example, goods may be placed into the central open area through the use of forklifts, conveyor belts, or the like. By way of another example, a raised stairway may be used to walk up and over the present invention in order to gain access thereto. Thus, the present invention provides greater accessibility for maintenance or service on all sides; i.e. the present device better allows more work to be performed thereon without the need to climb onto the machine, thus enhancing its safety.

Furthermore, the present invention may be configured to fit a given factory floor plan. For example, the device 100 of the present invention may be installed around structural columns so that the columns are disposed inside the open space 58.

Furthermore, the present invention allows printing all sides. Referring again to the embodiment shown in FIG. 4, the present device allows printing on the "end" stations as well as on the "side" stations.

For a given number of printing heads 26, the present invention can occupy less floor space than standard oval machines, as will be further described below. That is, the present invention allows more printing stations per given area of floor space than known round or oval machines. In other words the present invention allows the user to maximize the number of useable printing stations for a given floor constraint.

Figure 5:
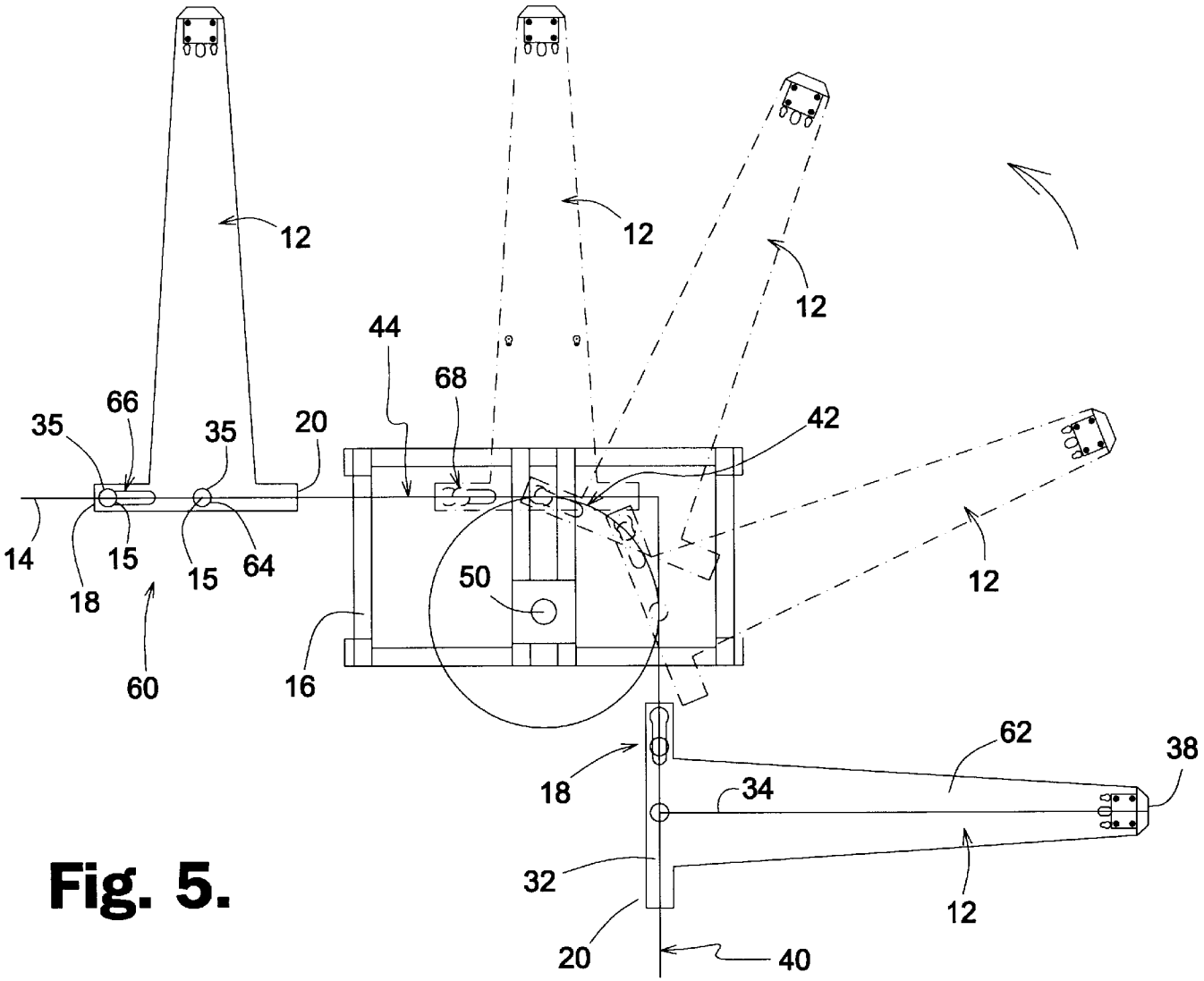
FIG. 5 illustrates a top plan view of preferred embodiment of a pallet according to the present invention including a preferred means for attaching the pallet to the endless chain.

FIG. 5 illustrates a preferred embodiment of a pallet 12 according to the present invention having means 60 for attaching the pallet 12 to the endless chain 14 so as to provide stability to the pallet and to maximize the perpendicular orientation of the pallet in relation to the chain. Thus, the present invention maximizes the useable portion of the path of the pallets 12 which can be outfitted with a printing head 26.

Still referring to FIG. 5, the pallet 12 comprises an elongated body 62 which is generally disposed about a longitudinal centerline 34 which extends from a front end 38 to a rear end 32. The body 62 is advanced around the support frame 16 while being maintained in a generally horizontal orientation with the front end being directed outwardly. The elongated body 62 has a rear portion 32 for attachment with the pallet drive means, e.g. an endless chain 14, the rear portion including leading 18 and trailing 20 sides oppositely disposed about the longitudinal centerline 34, wherein the rear portion 32 is provided with a substantially circular opening 64 disposed substantially at its midpoint, and provided with a slotted opening 66 proximate its leading side 18. Resilient mounts 35, which are optionally connected to the endless chain 14, may be disposed in the openings 64, 66. Thus, lateral movement within the slotted opening 66 compensates for changes in distance between the two supporting pins 15 when the chain 14 travels around the curved sections of the drive chain path, thus preventing binding at those sections.

FIG. 5 also illustrates the sequence of pallet positions experienced by a given pallet 12 during its travel, indicated by the arrow, around the arcuate portion of a pivot point or vertex 50 in a 90 degree corner of an endless path according to the present invention. It should be noted that the rear end 32 of the pallet 12 is not recessed, i.e. the pallet 12 does not overlap the pivot means, or wheeled member, or sprocket, 54 as the midpoint of the rear portion 32 of the pallet 12 advances to the juncture between the traverse portion 42 of the endless path and the tangential departing portion 44 of the endless path for a respective pivot, and the pallet 12 is essentially normal or perpendicular to the tangential departing portion 44 of the chain 14. Thus, a printing station may be disposed at this juncture position.

FIG. 5 shows one portion of a path of the endless chain to illustrate a tangential approach portion 40, a traverse portion 42, and a tangential departing portion 44 associated with each pivot point or wheeled member 54, wherein the endless chain 14 contacts the associated wheeled member 54 in the traverse portion 42, and wherein a line passing through the tangential approach portion 40 and a line passing through the tangential departing portion 44 intersect one another.

It should also be noted that the pallet 12 would be essentially normal (perpendicular) to the straight sections of the endless path until the leading attachment point, such as a resilient mount or a pin, of the rear portion 32 of the pallet 12 advances to the juncture between the tangential approach portion 40 of the endless path and the traverse portion 42 of the endless path.

Moreover, by decreasing the traverse portion 42 for each respective wheeled member 54, the present invention reduces the generation of centrifugal forces and torque requirements, or power requirements, associated with driving the pallets 12 as compared, for example, to the known oval printing devices which utilize a traverse portion of substantially 180 degrees. If the transmission of torque to sprockets 54 located at the vertices 50 is of concern in a particular embodiment of the present invention, two or more of the sprockets 54 may be coupled by an overrunning clutch assembly, such as available under the trade name of Formsprag, or as known to those skilled in the art, so that the two or more sprockets 54 may be driven together, thereby increasing the contact between the driving portions of the sprockets 54 and the chain 14. Such an assembly may comprise a ratchet wheel assembly, and may be self-adjusting so as to provide a means for adjusting for changes in chain length.

Figure 6:
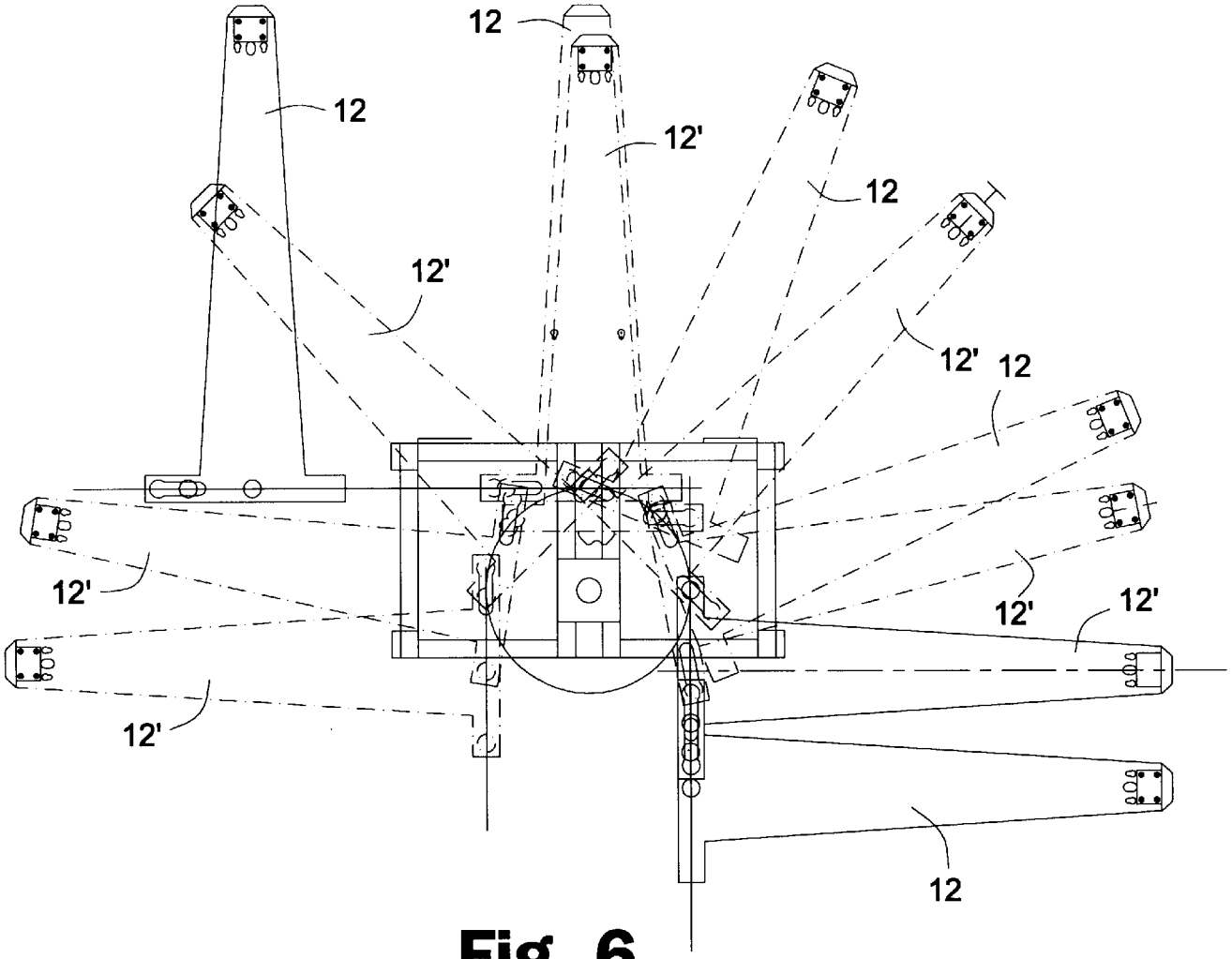
FIG. 6 illustrates a superposition of the sequential positions of the pallets corresponding to the known device of FIG. 2 and the instant device of FIG. 5.

FIG. 6 illustrates a superposition of the sequential positions of the pallets corresponding to the known device of FIG. 2 as marked by reference numeral 12' and the instant device of FIG. 5 as labeled by reference numeral 12, wherein the known pallet 12' changes its direction of travel by 180 degrees and the instant pallet 12 changes its direction of travel by 90 degrees. The lagging, recessed pallet tip of the known device 12' can be seen in comparison with the normal tip of the instant device 12 which would be parallel to the positions of the pallet on the downstream straight path.

Referring again to FIG. 4, the embodiment of the present invention illustrated therein is configured in a generally rectangular shape with 18 possible printing stations for a given repeat, in this example 36 inch repeats. Of course, for a particular machine, increasing the repeat, for example, from indexing to every 45 inches instead of every 36 inches, would decrease the number of possible printing stations and would affect their respective positions around the loop. It should be noted that, for a given embodiment, adjacent printing stations disposed around a particular vertex may not both be able to accommodate printing heads if the width of the printing heads would create interference therebetween.

FIG. 4 shows that the path of the pallets comprises at least one straight line of travel wherein all of the pallets which are present on the straight line of travel are substantially perpendicular to the straight line of travel and are substantially parallel to each other.

It is important to note that the present invention may be configured into many shapes and sizes, provided the endless loop contains three or more vertices 50. For example, the present invention may be configured into the shape of a triangle, square, rectangle, parallelogram, pentagon, hexagon, octagon, etc. One or more sides may have a length unequal to one or more of the other sides. Furthermore, different embodiments may utilize different repeats.

Figure 7:
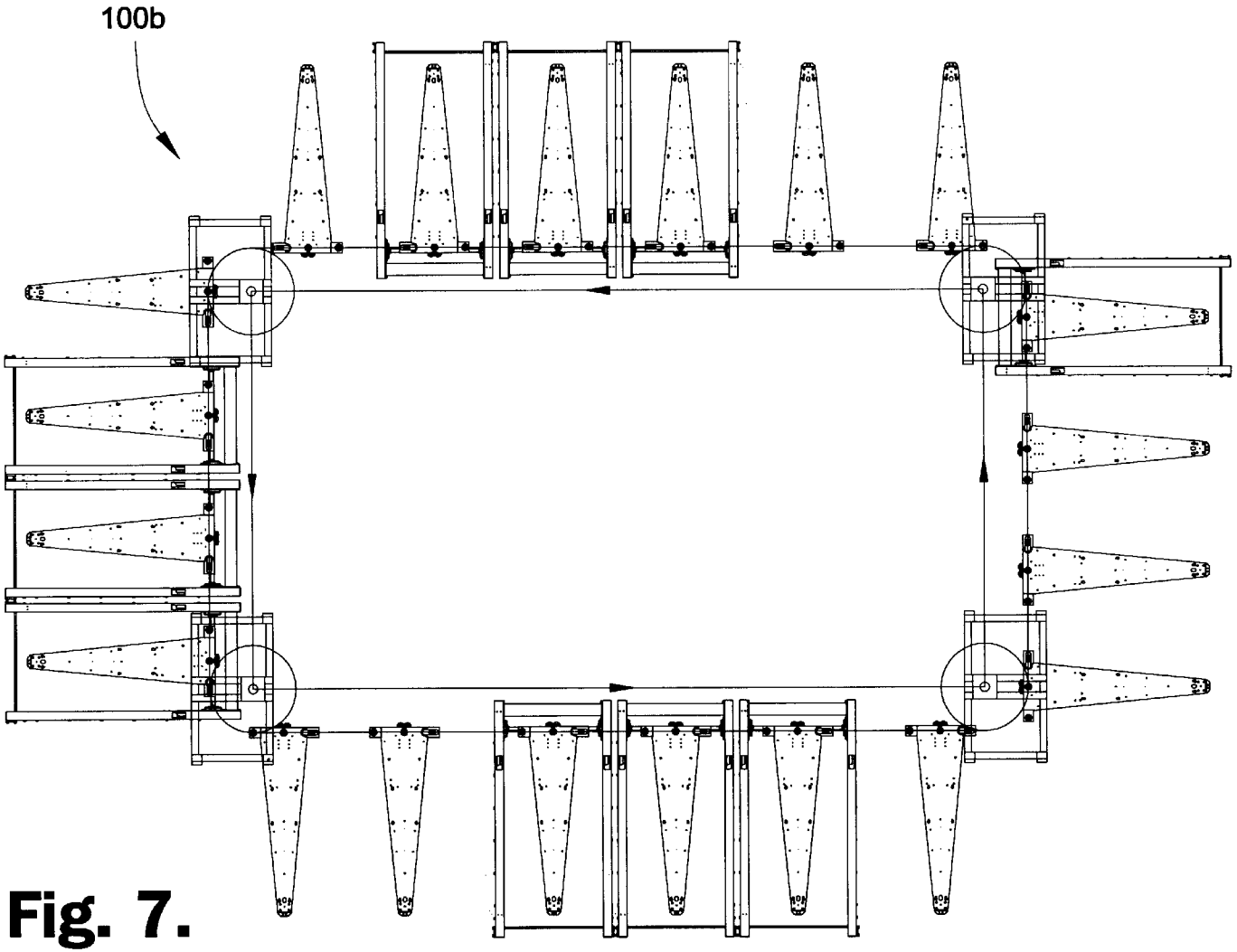
FIG. 7 is a top plan view of another embodiment of the present invention in a rectangular configuration which provides 20 stations.

FIG. 7 illustrates another embodiment 100*b* of the present invention in a rectangular configuration which provides 20 stations with a 24 inch by 32 inch print area on a 36 inch repeat. This embodiment occupies approximately generally fits within a 28 foot diameter, as indicated by the large circle, covering approximately 615 square feet, and could provide an open central area of approximately 168 square feet. By comparison, a 28 foot diameter rotary or round machine would provide 16 heads with no central area, and an 18 head oval machine would occupy approximately 457 square feet with no open central area.

Figure 8:
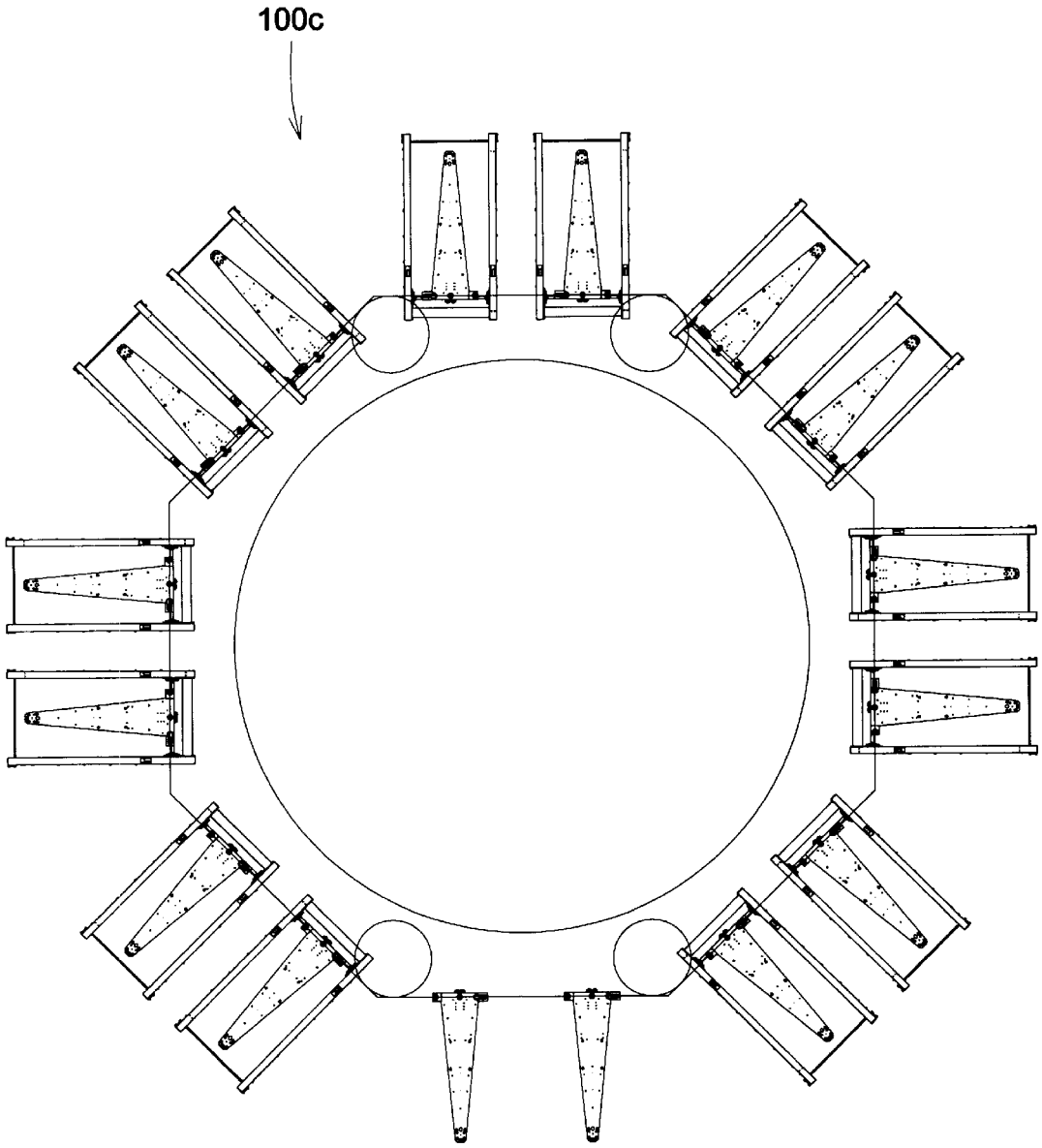
FIG. 8 is a top plan view of another embodiment of the present invention in an octagonal configuration which provides 16 stations.

FIG. 8 illustrates another embodiment 100*c* of the present invention in an octagonal configuration which provides 16 stations with a 24 inch by 32 inch print area on a 45 inch repeat. This embodiment occupies approximately 760 square feet, and could provide an open central area of approximately 188 square feet.

Figure 9:
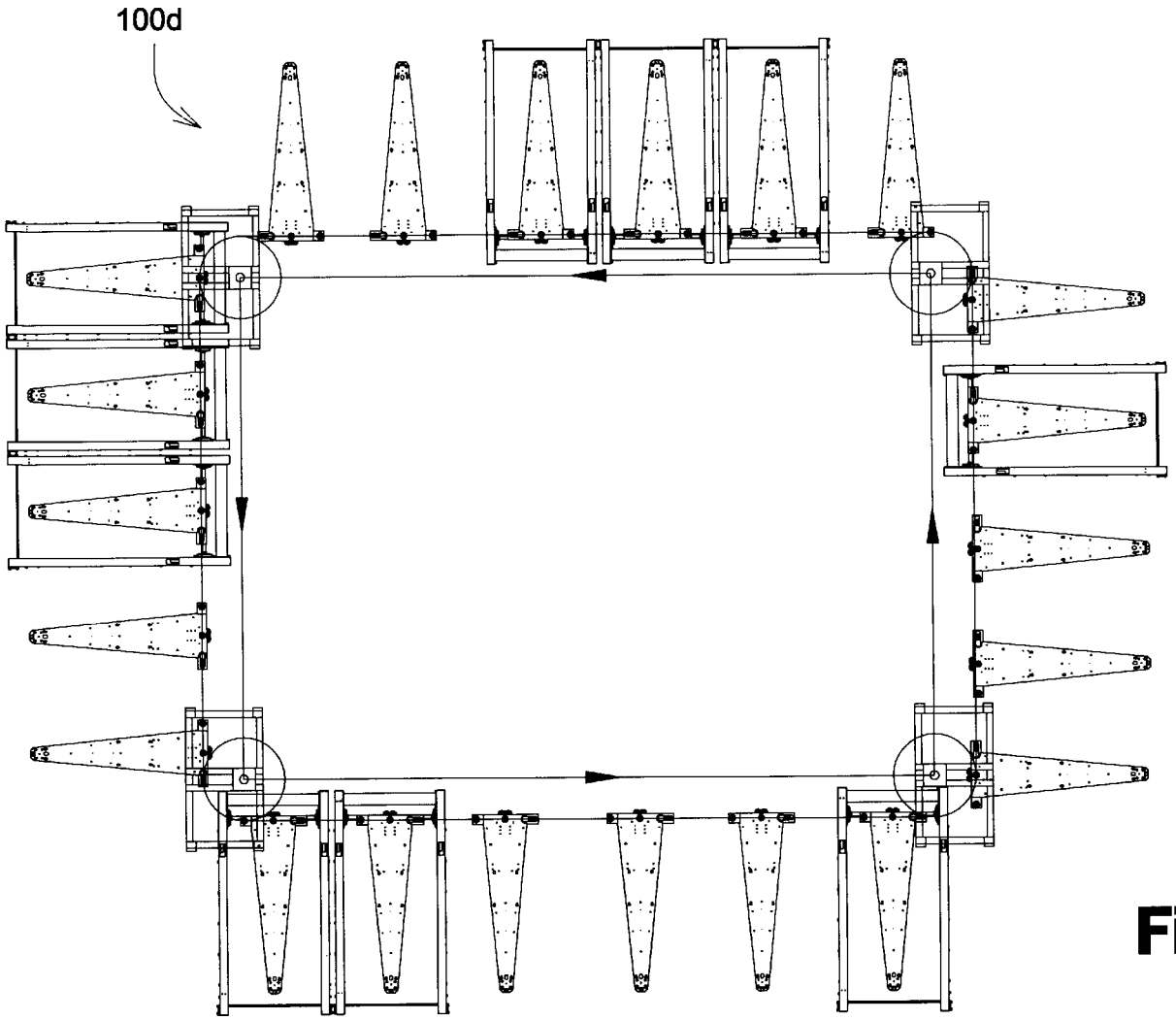
FIG. 9 is a top plan view of another embodiment of the present invention in an rectangular configuration which provides 22 stations.

FIG. 9 illustrates another embodiment 100*d* of the present invention in an rectangular configuration which provides 22 stations with a 24 inch by 32 inch print area on a 36 inch repeat. This embodiment generally fits within a 28 foot diameter, occupying approximately 708 square feet, and could provide an open central area of approximately 220 square feet. By comparison, a 28 foot diameter rotary or round machine would provide 16 heads with no central area, and a 22 head oval machine would occupy approximately 493 square feet with no central area.

Figure 10:
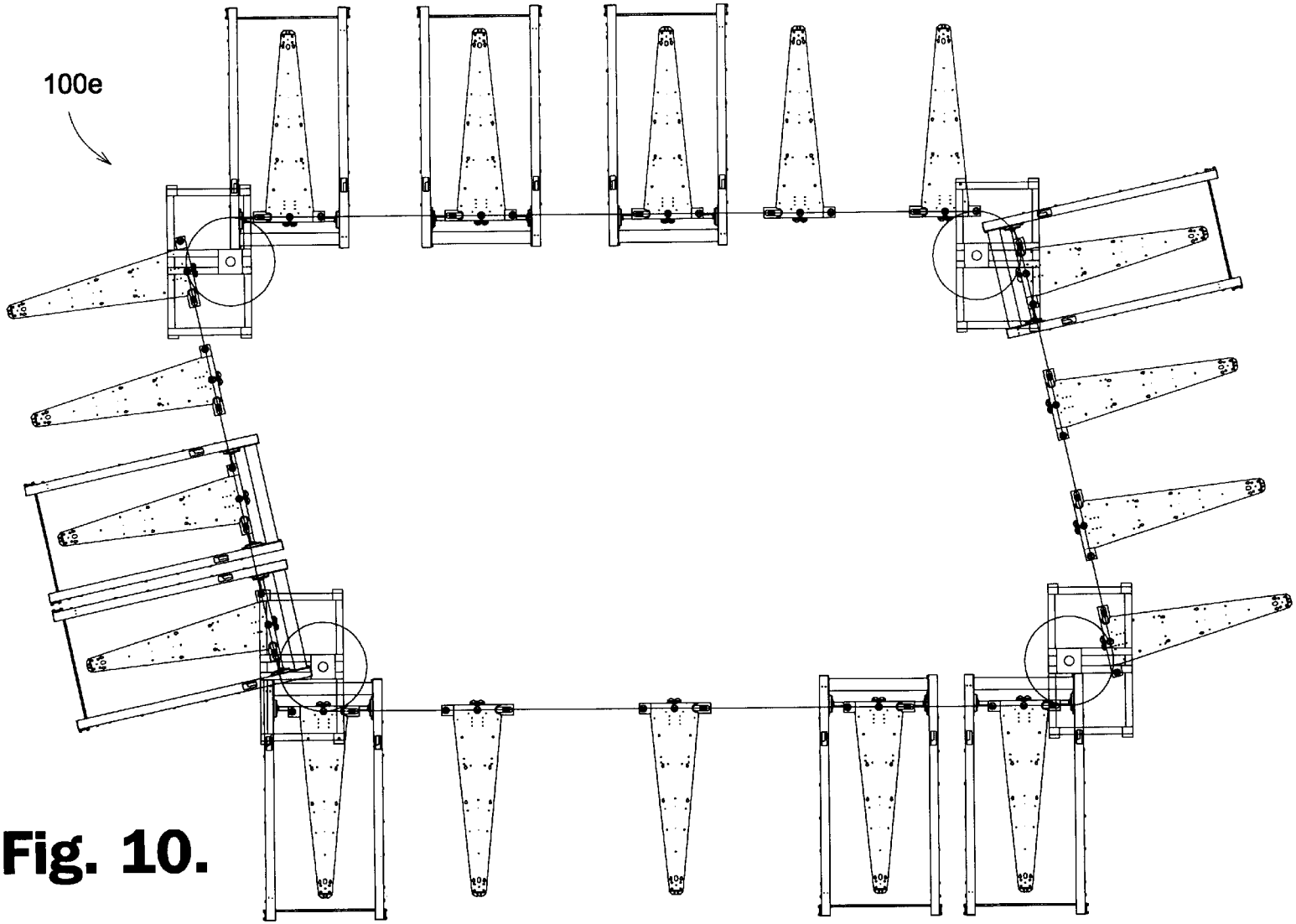
FIG. 10 is a top plan view of another embodiment of the present invention in a parallelogram configuration which provides 18 stations.

FIG. 10 illustrates another embodiment 100*e* of the present invention in a parallelogram configuration which provides 18 stations with a 24 inch by 32 inch print area on a 36 inch repeat. This embodiment generally fits within a 28 foot diameter, covering approximately 543 square feet and could provide an open central area of approximately 139 square feet. By comparison, a 28 foot diameter rotary or round machine would provide 16 heads with no central area, and an 18 station oval machine would occupy approximately 413 square feet with no central area.

The present invention may assume a variety of embodiments, and the embodiments illustrated and described herein are in no way intended to be limiting.

For example, although a rotatable member or sprocket has been described as forming the vertices or pivot points of the endless path, other variations may be possible, such as a stationary pivot member which allows an endless chain having rollers to pass thereupon. The rotatable member may instead be a smooth wheel or a roller. The vertices may be provided with driving pivots or tensioning pivots.

By way of further example, a different endless drive means or means of attaching each pallet to the endless drive means may be provided, such as by attaching the pallets to a horizontal shaft extending outwardly from the endless chain. By way of another example, resilient mountings may be optionally left out of a particular embodiment of the present invention, especially if a particular configuration is adapted to significantly reduce stresses associated with resilient mount attachment points.

The present invention may further be configured to have arbitrary or irregular shapes or outlines, for example in order to obtain a custom fit into the available space or pathway of a given floor plan, or for any of a variety of reasons. Moreover, the present invention can be extended or directed in virtually any direction on the supporting floor surface.

It should further be appreciated that a printing device according to the present invention may be placed adjacent to another printing device according to the present invention, for example, so that straight portions of the respective devices are aligned next to each other, so as to maximize the total floor space usage at a given facility. For example, in comparison to an adjacent pair of rotary or round devices, a greater number of printing stations may be disposed upon a given area of factory floor with the present invention.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing apparatus comprising:

a polygonal support frame;

a plurality of spaced apart pallets movably mounted on said support frame;

a pallet drive means mounted to said support frame and connected to said pallets for indexing said pallets around said support frame to desired printing locations, said pallet drive means further comprising an endless drive means including a moveable endless chain; and a means for pivotally attaching the midpoint of the rear end of each pallet to said endless chain.

2. The printing apparatus according to claim 1 wherein said support frame is configured as having an irregular polygonal shape.

3. The printing apparatus according to claim 1 wherein said support frame is configured as having a regular polygonal shape.

4. The printing apparatus according to claim 1 wherein said pallets are resiliently mounted to said pallet drive means.

5. The printing apparatus according to claim 1 wherein the path of said endless chain includes a tangential approach portion, a traverse portion, and a tangential departing portion associated with each wheeled member, wherein said endless chain contacts said associated wheeled member in said traverse portion, and wherein a line passing through the tangential approach portion and a line passing through the tangential departing portion intersect one another.

6. The printing apparatus according to claim 5 wherein said pallet is essentially normal to said endless chain when disposed at the juncture between said traverse portion and said tangential departing portion.

7. The printing apparatus according to claim 1 further comprising means for pivotally and slidingly attaching the leading end of each pallet to said endless chain.

8. A printing apparatus comprising:

a polygonal support frame;

a plurality of spaced apart pallets movably mounted on said support frame;

a pallet drive means mounted to said support frame and connected to said pallets for indexing said pallets around said support frame to desired printing locations, said pallet drive means further comprising an endless drive means including a moveable endless chain; and a means for allowing said rear portion of said pallet to pivot with respect to said endless chain about an upright axis passing through the longitudinal centerline of said pallet while allowing the leading edge of said rear portion to slide with respect to said endless chain, whereby said pallet is able to follow the curvilinear portion of the endless path around a respective wheeled member.

9. The printing apparatus according to claim 8 wherein the longitudinal axis of said pallet is essentially perpendicular to the endless chain at the point where the endless chain departs the respective wheeled member.

10. A printing apparatus comprising:

a polygonal support frame having an endless path;

a plurality of spaced apart pallets movably mounted on said support frame along said endless path;

pallet drive means mounted to said support frame and connected to said pallets for indexing said pallets around said support frame to desired printing locations;

said pallet drive means further comprises an endless drive means including a movable endless chain;

means for allowing a rear portion of said pallet to pivot with respect to said endless chain about an upright axis passing through the longitudinal centerline of said pallet while allowing the leading edge of said rear portion to slide with respect to said endless chain, whereby said pallet is able to follow the curvilinear portion of the endless path around a respective wheeled member;

wherein said curvilinear portion of said endless path is segmented in relation to the number of polygonal sides.

11. A printing apparatus comprising:

a support frame defining a plurality of printing stations;

an endless drive chain supported on the frame for movement relative to the printing stations; and a plurality of elongated pallets secured to the chain for movement between the printing stations, each pallet defining a longitudinal axis and including a rear end disposed adjacent the chain and a front end spaced from the chain, the rear end presenting a leading side, a trailing side, and a midpoint located halfway between the leading and trailing sides, wherein each pallet is secured to the chain by a first pin connected between the midpoint of the rear end of the pallet and the chain.

12. The printing apparatus as recited in claim 11, wherein each pallet includes a slot formed in the leading side, the slot extending in a direction generally perpendicular to the longitudinal axis of the pallet, each pallet being further supported on the chain by a second pin received in the slot and connected to the chain.

13. The printing apparatus as recited in claim 11, further comprising a resilient mount between the chain and each pallet.

14. The printing apparatus as recited in claim 13, wherein the resilient mount is disposed between the first pin and each pallet.

* * * * *